US005122038A

United States Patent [19]

Malkoski

[11] Patent Number: 5,122,038

[45] Date of Patent: Jun. 16, 1992

[54] HIGH DENSITY GROUT PUMP

[75] Inventor: Michael L. Malkoski, Lively, Canada

[73] Assignee: Inco Limited, Toronto, Canada

[21] Appl. No.: 652,794

[22] Filed: Feb. 8, 1991

[30] Foreign Application Priority Data

Feb. 13, 1990 [CA] Canada ..... 2009905

[51] Int. Cl.[5] ..... F04B 39/14

[52] U.S. Cl. ..... 417/313; 366/295; 366/325; 285/311; 417/430; 417/900

[58] Field of Search ..... 417/205, 430, 900, 313; 418/48; 366/293, 295, 325, 328, 329; 285/311, 312

[56] References Cited

U.S. PATENT DOCUMENTS

| | | | |
|---|---|---|---|
| 2,065,022 | 12/1936 | Poulter | 417/900 |
| 2,143,750 | 1/1939 | Darby et al. | 366/295 |
| 2,482,175 | 9/1949 | Hamilton | 285/312 |
| 2,772,836 | 12/1956 | Gebhart | 285/311 |
| 3,216,768 | 11/1965 | Soeding et al. | 418/48 |
| 3,693,842 | 9/1972 | Cozzarin et al. | 417/900 |
| 3,950,250 | 4/1976 | Jahnsen | 366/325 |
| 4,117,547 | 9/1978 | Mathis et al. | 366/17 |
| 4,136,975 | 1/1979 | Forseth | 366/325 |
| 4,723,900 | 2/1988 | Vuorenoja | 425/204 |
| 5,030,011 | 7/1991 | Kronberg | 366/325 |

FOREIGN PATENT DOCUMENTS

| | | | |
|---|---|---|---|
| 385309 | 3/1985 | Austria . | |
| 0037294 | 10/1981 | European Pat. Off. | 417/205 |
| 0206031 | 12/1986 | European Pat. Off. . | |
| 1244723 | 7/1967 | Fed. Rep. of Germany . | |
| 1277819 | 9/1968 | Fed. Rep. of Germany . | |
| 1459258 | 5/1969 | Fed. Rep. of Germany . | |
| 51674 | 1/1971 | Fed. Rep. of Germany . | |
| 96994 | 5/1973 | Fed. Rep. of Germany . | |
| 2543379 | 3/1977 | Fed. Rep. of Germany . | |
| 2331585 | 6/1977 | Fed. Rep. of Germany . | |
| 2802683 | 7/1979 | Fed. Rep. of Germany . | |
| 2947913 | 6/1981 | Fed. Rep. of Germany . | |
| 3710930A1 | 10/1988 | Fed. Rep. of Germany . | |
| 3724503 | 2/1989 | Fed. Rep. of Germany . | |
| 3809661 | 10/1989 | Fed. Rep. of Germany . | |
| WO8703652 | 6/1987 | Finland . | |
| 0737649 | 5/1973 | U.S.S.R. | 417/205 |
| 317984 | 8/1929 | United Kingdom . | |
| 891334 | 3/1962 | United Kingdom . | |
| 977687 | 12/1964 | United Kingdom . | |
| 1021778 | 3/1966 | United Kingdom . | |
| 1124531 | 8/1968 | United Kingdom . | |
| 1243544 | 8/1971 | United Kingdom . | |
| 2074240 | 10/1981 | United Kingdom . | |

OTHER PUBLICATIONS

M.A.I.-Pump-System, GD-Anker GES.M.B.H.; pp. 1-12 (date unknown).

Putzmeister, CM System for Continuous Mixing; pp. 1-14 (date unknown).

Moyno, Pressure Grating (Aug. 6, 1965); pp. 1-2.

Pumpen mit Zufuhrschnecken fur schwierigste Fordermedien. In: Technische Information der NMP, 130/1/77, eingeg. im DPA 7.6.78; 1,2,9.

Mechanical Handling Exhibition. In: The Engineer, 1964, S.862: FIG. 12.

*Primary Examiner*—Richard A. Bertsch
*Assistant Examiner*—Michael I. Kocharov
*Attorney, Agent, or Firm*—Francis J. Mulligan, Jr.; Edward A. Steen; Bruce S. Londa

[57] ABSTRACT

A pump capable of shear mixing and supplying high density grout over long distances and through relatively narrow conduits. The pump includes a hopper, a series of agitators in the hopper and a coincident auger and rotor/stator disposed below the hopper. The pump is held together by a pair of side bars having quick release bear clamp clasps for expeditious disassembly.

6 Claims, 2 Drawing Sheets

HIGH DENSITY GROUT PUMP

TECHNICAL FIELD

The instant invention is directed towards pumps in general, and more particularly, to high density grout pumps especially useful for mining applications.

BACKGROUND ART

In order to stabilize and support underground excavations, such as mine stopes, drifts, galleries, etc., grouted rock and cable bolts are oftentimes utilized. Grout is prepared, mixed and pumped into the bore hole where it sets about the bolt.

There are a number of grout pumps presently available. However, they generally are limited to pumping low density cementitious grouts. That is, grouts having a 0.4/1.0 water/cement ratio (by weight) or higher i.e., 0.5/1.0 water/cement ratio. Thinner grouts mean less bonding strengths and lower efficiency in support systems. Moreover, due to the very nature of the grout, pumps are prone to frequent stoppages due to blockage and plugging.

Higher density grout i.e., 0.3:1 water/cement, which is more desirable, does not flow well with current pump designs. In order to cause high density grout to flow, the grout must be subject to a shear mix action. For the purposes of this specification, shear mix means that each cement particle is fully coated with water. Conventional mining grout pumps that are able to pump high density grouts cannot shear mix the high density grout.

Other pumps, if they pump a shear mix, cannot pump high density grout. An available shear mix system includes mixing blades that must rotate at 1750 revolutions per minute. These high speed systems are not practical for mining applications. Other designs employ piston type pumps which create surges that will not pass through long, small openings, i.e.—pipe bolts.

It is apparent that a grout pump is needed to easily and consistently pump a high density water/cement grout over long distances and at acceptable flow rates for bolting purposes.

SUMMARY OF THE INVENTION

This invention relates to an easily disassembled, high density grout pump. A multi-action agitator disposed in a hopper assists in creating a first shear mix. An auger disposed below the hopper, transports the grout to a rotator/stator and then through an outlet conduit. The auger shear mixes the grout for a second time. The grout flow can be repeatedly stopped and started without blockages occurring.

PREFERRED EMBODIMENT OF THE INVENTION

Figure 1:
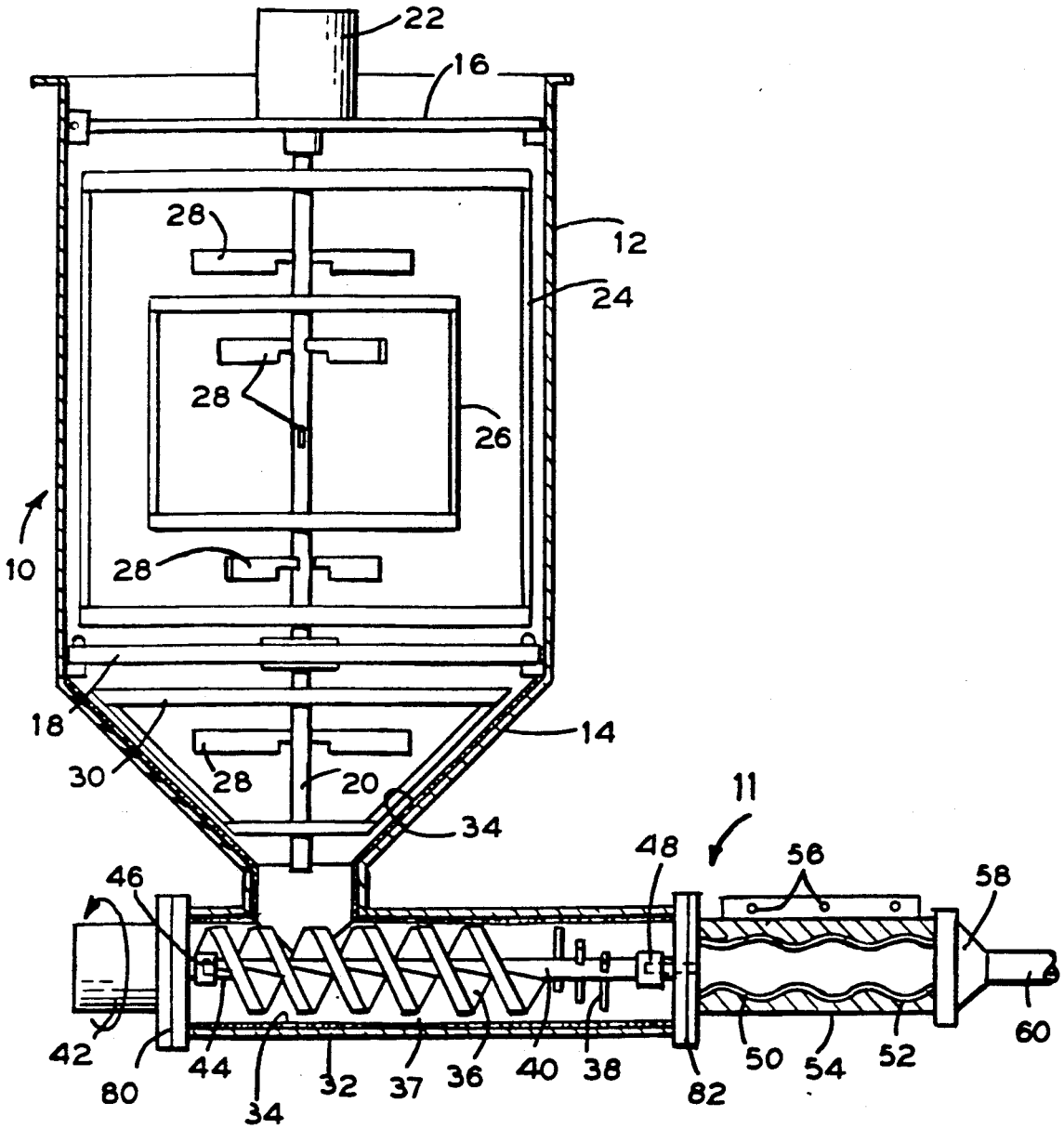
FIG. 1 is a cross-sectional side view of an embodiment of the invention.

Referring to FIG. 1, there is shown a high density grout pump 10. The grout pump 10 is designed to consistently shear mix and supply high density grout, i.e.

grout having a ratio of 0.3 to 1 water to cement, over sufficiently long distances and at suitable pressures. Standard grout pumps supply low density grouts—0.4/1.0 water to cement ratios (by weight).

The pump 10 includes hopper 12 and cone 14 comprising a container. A supporting bracket 18 is disposed within the hopper 12 to stabilize and support shaft 20. Motor 22 is detachably registered with the shaft 20 and is attached to an upper support bracket 16. As the bracket 16 is swung up, the motor 22 is detached from the shaft 20.

The shaft 20 includes a series of grout mixers attached thereto. The upper support bracket 16 also supports the various mixers. Outer paddle 24 is an open quadrilateral. Inner paddle 26 is also an open quadrilateral. Although shown in FIG. 1 for visualization purposes parallel with the outer paddle 24, it is preferred to orient the inner paddle 26 ninety degrees away from the outer paddle 24. A plurality of container shear blades 28 are staggered about the shaft in forty-five degree angle separations.

A cone paddle 30, in the form of an open trapezoid is mounted on the shaft 20 below the supporting bracket 18 and parallel with the outer paddle 24. The cone 14 is attached to auger tube 32.

The cone 14 and auger tube 32 are continuously lined with an erosion resistant neophrene rubber liner 34. The auger tube 32 is supported by end plates 80 and 82.

The auger tube 32 houses a counterclockwise rotating auger 36. A spiral thread 37 extends along a portion of auger shaft 40. A plurality of reverse action shear blades 38, essentially rods extending out from the shaft 40, are spirally mounted on the auger shaft 40. The auger shaft 40 is detachably connected to motor 42. The driven end 44 of the shaft 40 is simply press fitted into square coupling 46. By rotating in the counterclockwise direction, the auger 36 will not disconnect from the box coupling 46 when the auger tube 32 is filled with grout. A portion of the grout pushes back upon the auger 36 to maintain the coupling connection with the motor 42.

The distal end of the auger shaft 40 is similarly press fitted into square coupling 48 with serpentine rotor 50. The rotor 50 is fitted into a correspondingly profiled rubber stator 52 disposed within stator housing 54. A preferred rotor 50/stator 52 combination (model D81.5) is distributed by Bornemann Pumps Inc., Brampton, Ontario.

The stator housing 54 is fastened together by fasteners 56. Outlet 58 extends away from the stator housing 54 and is adapted to be connected to conduit 60 and in turn to a suitable valve and/or means for introducing the grout into a hole (not shown).

Figure 3:
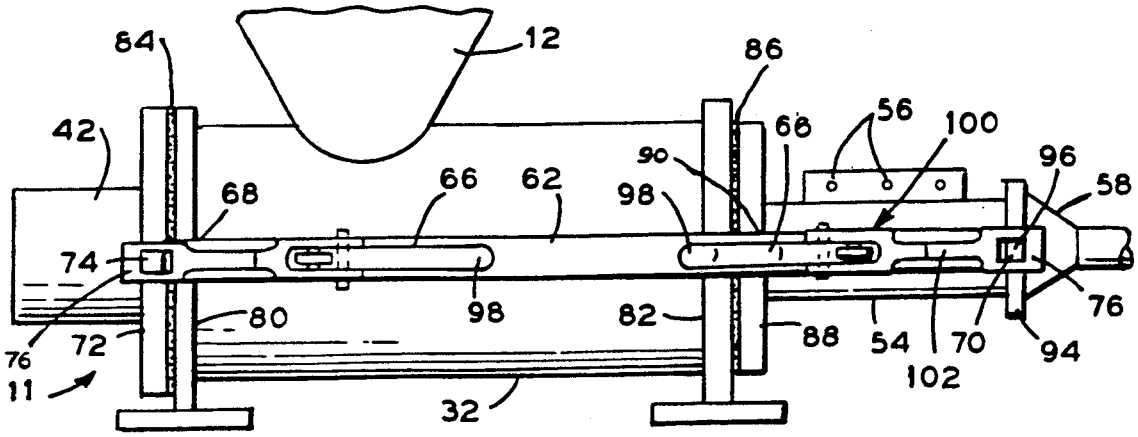
FIG. 3 is a side view taken along line 3—3 in FIG. 2.
Figure 2:
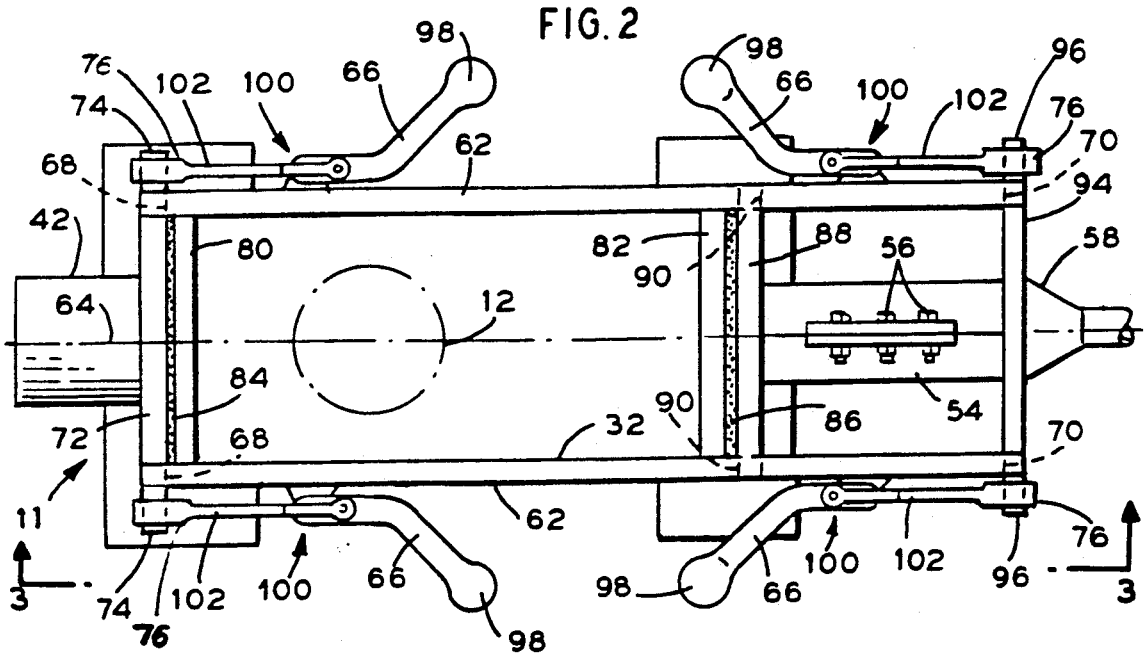
FIG. 2 is a plan view of an embodiment of the invention.

Turning now to FIGS. 2 and 3, the lower pump housing 11 comprises the auger tube 32 and the stator housing 54, which are releasably connected as described below. The lower pump housing 11 may be easily dismantled and reassembled to gain access to its interior. A pair of side bars 62 extend parallel to the longitudinal axis 64 of the lower pump housing 11. The side bars 62 are bolted or otherwise affixed to the auger tube 32.

Figure 4:
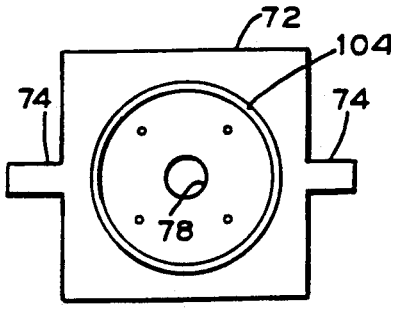
FIG. 4 is a plan view of a feature of the invention.

Each side bar 62 includes notches 68 and 70 disposed at the opposed ends. Motor plate 72 (FIG. 4) includes two tabs 74 that fit into the notches 68. The tabs 74 extend beyond the notches 68 so that boxes 76 of the clasps 66 fit over them. Aperture 78 accommodates the shaft (not shown) of the motor 42. Rubber gasket 84 fits between the motor plate 72 and the end plate 80.

Figure 5:
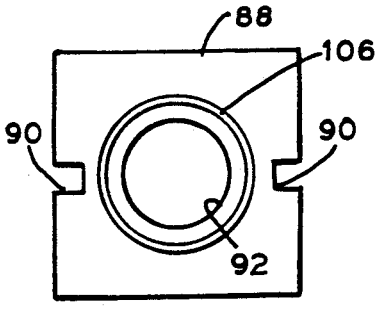
FIG. 5 is a plan view of a feature of the invention.

Disposed about the end plate 82 is rubber gasket 86 followed by stator plate 88 (FIG. 5). The stator plate 88 contains two notches 90 to accommodate the side bars 62. Aperture 92 allows the grout to flow into the stator housing 54.

Figure 6:
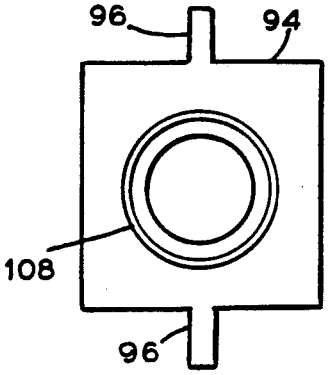
FIG. 6 is a plan view of a feature of the invention.

An outlet plate 94 (FIG. 6), having tabs 96, closes off the stator housing 54 and is registered with the outlet 58. The tabs 96 extend through the notches 70 and into the boxes 76 of the clasps 66.

The plates 72, 88 and 94 all include raised lips 104, 106 and 108 respectively for sealing the lower pump housing 11 when the clasps 66 are tight.

The bear clamp clasps 66 include handle 98, pivot assembly 100, telescoping member 102 and the box 76. The quick release clasp 66 fits over the tabs 74 and 96 and is locked to hold the side bars 62 and the plates 72 and 94 in position. The length of the members 102 may be adjusted.

The bars 62 line up the plates 72, 88 and 94. The bear claws 100 are bolted to the side bars 62 and are snap tightened to hold the plates 72, 88 and 94 as well as the rotor 50 and the stator 52 together.

In order to open the lower pump housing 11, the handles 98 are snapped open, freeing the tabs 74 and 96 and allowing the plates 72 and 94 to be removed. By releasing the bear clasps 66, the stator housing 54 may be also freed from the stator plate 88, allowing the rotor 50 to be uncoupled from the distal end coupling 48. Similarly, by removing the motor plate 72, the auger 36 may be withdrawn from the auger tube 34.

The invention and the manner of applying it may be better understood by a brief discussion of the principles underlying the invention.

A major goal of the instant pump 10 is to batch pump high density grout by shear mixing it and then propelling it through a relatively narrow conduit (i.e. 0.75 inch [19 mm] diameter) over a long distance (50 feet [18.2 meters]) without blockage.

The appropriate quantities of materials are poured into the hopper 12. For 0.3/1 high density grout, 15 kilo bags of Portland 10 cement and 90 liters of water are introduced into the hopper 12. This composition weighs about 356 kgs (788 pounds) Both motors 22 and 42 are energized. Until the mixture is adequately mixed, the conduit 60 (or a diverter valve) feeds the grout back into the hopper 12.

As the auger 36 pushes the mixture towards the rotor 50/stator 52, the shear blades 38 shear mix the grout and cause a portion of the grout to flow back into the auger tube 32 towards the hopper 12 and away from the rotor 50/stator 52. For example, if 100 units/time of grout are delivered by the auger 36, only 10 units/time of grout may pass through the rotor 50/stator 52; the remaining 90 units are forced back into the hopper where the paddles 24, 26, 30 and shear blades 28 can continue to act upon the grout to churn and shear mix it further.

The arrangement in the hopper 12 allows for quicker and more thorough mixing. The inner paddle 26 and shear blades 28 create a vortex that discourages the cement from balling up, allowing reasonable rotation rates. In contrast, high density grout poured into a standard drum mixer balls up and does not become suitably wetted. The shaft 20 may be run between 30–60 rpm as opposed to otherwise nonsuitable pumps turning at 1750 rpm.

Since auger 36 simply couples 46 and 48 to the motor 42 and the rotor 50/stator 52, it does not require special offset cams or couplex gearing assemblies.

The spirally offset shear blades 38 perform two functions. Firstly they do not impact the grout at the inlet of the rotor 50/stator 52. This would cause the water to be forced out of the grout and create blockage problems further down the line. Secondly, and as previously discussed, the blades 38 shear mix the grout, only a portion of which actually passes into the rotor 50/stator 52.

The rotor 50, as is the auger 36, is simply inserted into a square coupling 48 that allows for press fitted joining. Since the auger 36 and the rotor 50 are in-line, their concentric turning action does not require a special cam on the auger 36.

By virtue of the fasteners 56, the stator 52 may be adjusted to regulate the output pressure of the grout as well as lengthen the life of the stator 52.

Cleaning the lower pump housing 11 is a simple operation. By releasing the clasps 66, the plates, gaskets, auger and rotor/stator may be removed.

Since the grout pump 10 is designed for batch operations, the consistency of the grout propelled through the outlet 58 remains constant. The shear mix action reduces blockages and line plugging. Since the grout is always available, the pump may be repeatedly stopped and started with no interference with flow rates. Indeed prototype units have been built capable of pumping 15 liters/minute of high density grout (0.3/1 water/cement) through 0.75 (19 mm) diameter conduit 50 feet (15.2 m) long at 50 pounds per square inch (345 kPa) to a 20 foot (6.1 m) cable bolt. Moreover, the pump may be used to spray shotcrete if desired.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A high density grout pump comprising a container, a rotatable container shaft extending into the container, the container including a hopper and a cone, a plurality of agitating means affixed to the shaft within the container, the container attached to an auger tube, a rotatable auger disposed within the auger tube, the auger including spiral threads and a plurality of shear blades, a rotor and a stator disposed within a stator housing, the stator housing affixed downstream of the auger tube to comprise therewith a lower pump housing, the auger and rotor coincident with a longitudinal axis extending therethrough, a plurality of removable apertured plates extending substantially perpendicular to the longitudinal axis, a first apertured plate and second apertured plate being disposed at opposite ends of the lower pump housing, an outlet affixed to the stator housing, and releasable clasp means for maintaining the auger, rotor and stator intact, the clasp means including a pair of side bars extending parallel with the auger tube and the stator housing, the side bars including notches disposed at opposing ends, and tabs on the first and second apertured plates extending through the notches in the side bars.

2. The pump according to claim 1 wherein a pivotal clasp is mounted on the side bar, the clasp including a box removably enveloping a tab extending from a plate.

3. The pump according to claim 1 wherein the interior of the cone and the interior of the auger tube are lined with a continuous elastic coating.

4. The pump according to claim 1 wherein the auger is coupled to a driving means by a square coupling and the rotor is coupled to the auger by a square coupling.

5. The pump according to claim 1 wherein an outer open quadrilateral paddle and an inner open quadrilateral paddle are affixed to the shaft, and the outer and inner paddles are oriented 90° from one another.

6. The pump according to claim 5 wherein a plurality of container shear blades are spirally disposed about the container shaft.

* * * * *